United States Patent [19]

Torii et al.

[11] 4,387,913

[45] Jun. 14, 1983

[54] NO-CARBON COPYING PAPER

[75] Inventors: Takahiro Torii, Hyogo; Hideaki Senoh, Takasago, both of Japan

[73] Assignee: Mitsubishi Paper Mills, Ltd., Tokyo, Japan

[21] Appl. No.: 299,225

[22] Filed: Sep. 3, 1981

[30] Foreign Application Priority Data

Sep. 9, 1980 [JP] Japan ..... 55-125014

[51] Int. Cl.[3] ..... B41M 5/22

[52] U.S. Cl. ..... 282/27.5; 427/150; 427/151; 427/152; 428/320.4; 428/488; 428/511; 428/514; 428/521; 428/914

[58] Field of Search ..... 282/27.5; 427/150–152; 428/320.4, 320.6, 488, 537, 914, 207, 211, 331, 511, 514, 521, 522; 106/21, 31

[56] References Cited

U.S. PATENT DOCUMENTS 4,020,261 4/1977 Oda et al. ..... 427/150

4,234,212 11/1980 Kato et al. ..... 282/27.5

*Primary Examiner*—Bruce H. Hess

*Attorney, Agent, or Firm*—Cushman, Darby & Cushman

[57] ABSTRACT

There is disclosed no-carbon copying paper composed fundamentally of a color former sheet produced by coating a support with microcapsules containing a colorless electron-donative organic compound as a color former and a color developer sheet produced by coating a support with a coating color containing activated clay as a color developer which adsorbs the aforesaid electron-donative organic compound to develop color. When said coating color is prepared by adding a polyvinyl alcohol, a styrene-butadiene latex and a wax emulsion to the activated clay, it becomes possible to apply it at a high concentration and there are accomplished the maintenance of surface strength of the color developer sheet, the decrease in stains on the blanket and the improvement in sunlight resistance of the colored characters and in the aptitude for pasting.

7 Claims, 5 Drawing Figures

NO-CARBON COPYING PAPER

BACKGROUND OF THE INVENTION

1. Field of the Invention

This invention relates to no-carbon copying paper, more particularly to improvements in no-carbon copying paper produced by combining microcapsules containing a colorless electron-donative organic compound with activated clay which is an adsorbent material capable of adsorbing said organic compound to develop color.

2. Description of the Prior Art

No-carbon copying paper is well known, and, for example, those disclosed in U.S. Pat. Nos. 2,712,507, 2,800,457 and 2,730,457 are produced by combining microcapsules containing a colorless electron-donative organic compound (hereinafter referred to as "color former") with an electron-attractive adsorbent material (hereinafter referred to as "color developer") which adsorbs said color former to develop color.

No-carbon copying paper is composed of a sheet (called "top sheet") produced by providing a support with a layer of microcapsules containing a color former, a sheet ("under sheet") produced by providing a support with a color developer layer and, if necessary, one or more sheets ("intermediate sheets") inserted between top sheet and under sheet, which intermediate sheets are produced by providing the right side of a support with a color developer layer and its back side with the above-mentioned microcapsule layer. The term "color developer sheet" hereinafter used refers to both above-mentioned under sheet and intermediate sheet.

Microencapsulation has heretofore been carried out by a coacervation method, an interfacial polymerization method, an in situ method, or the like, and as the color former, there are used malachite green lactone, crystal violet lactone, benzoyl leucomethylene blue, rhodamine B lactam, 3-dialkylamino-7-dialkylamylfluoran, 3-metyl-2,2-spirabi (benzo-[f]-chromene), and the like. As the color developer, there are generally used, for example, solid acids such as acid clay, activated clay, attapulgite, zeolite, bentonite, and the like; phenol resins such as p-tert-butylphenol resin, p-phenylphenol resin, p-octylphenol resin, and the like; organic compounds such as succinic acid, tannic acid, malonic acid, maleic acid, gallic acid, and the like; and aromatic carboxylic acids such as benzoic acid, salicylic acid, substituted salicylic acids, naphthoic acid, diphenic acid, and the like and metallic compounds thereof.

Among these color developers, those practically used from a consideration of their characteristics are activated clay, phenol resins and substituted salicylic acids (or their salts).

Among these color developers, organic color developers such as phenol resins, substituted salicylic acids, and the like are disadvantageous in that they tend to be decomposed by sunlight to change color to yellow and in that the colored characters have so poor solvent resistance that they are defaced. On the other hand, the solid acids as inorganic color developers are free from these disadvantages and can improve the shelf life of the coated paper. Activated clay used as the color developer is prepared by treating acid clay or analogous clay with a mineral acid to dissolve the acid-soluble basic components such as alumina, iron, and the like, and thereby adjusting its surface area to 200 $m^2/g$ or more, as described in Japanese Patent Publications Nos. 2,373/1966, 7,622/1966, 8,811/1967. etc. Activated clay is amorphous from X-ray observation, has a large surface area, and is very different in properties from pigments for coating ordinary paper.

Kaolin, a representative clay for coating paper, shows fluidity when dispersed in water up to a concentration of 70% or higher. On the other hand, activated clay becomes highly viscous and loses fluidity to gel at a concentration of about 45%. At present it is desired from a viewpoint of productivity and economy in energy to apply a clay for coating paper in the form of a highly concentrated coating color. However a highly concentrated coating color of activated clay is very difficult to prepare for the reasons mentioned above, and therefore, in the existing circumstances, there is mainly employed an air knife coater method using a coating color of a low concentration.

When kaolin and activated clay were individually added in an equal amount to starch and latex and each of the resulting mixtures was applied to paper, after which the surface strength and the stains on the blanket at the time of printing were measured, there were obtained such results that in the case of using kaolin, much higher surface strength and less stain on the blanket were brought about than in the case of using activated clay. When the adhesive is further added to activated clay, the surface strength is improved and the stains on the blanket is reduced a little. However the depth of developed color is decreased so that the aptitude as a color developer sheet for no-carbon copying paper is lost.

SUMMARY OF THE INVENTION

An object of this invention is to lower the viscosity of activated clay-containing coating color for a color developer sheet used in no-carbon copying paper to improve its fluidity and thereby make it possible to apply it at a high concentration.

Another object of this invention is to maintain the surface strength of a color developer sheet, prevent stains on the blanket at the time of printing, prevent the lowering of the colored characters, obtain excellent sunlight resistance of the colored characters, and keep the aptitude for pasting.

The above-mentioned objects of this invention have been accomplished by no-carbon copying paper composed fundamentally of a color former sheet produced by coating a support with microcapsules containing a colorless electron-donative organic compound as a color former and a color developer sheet produced by coating a support with a coating color containing activated clay as a color developer which adsorbs the aforesaid electron-donative organic compound to develop color, wherein the aforesaid activated clay-containing coating color is prepared by adding polyvinyl alcohol, styrene-butadiene latex and a wax emulsion to activated clay.

DETAILED DESCRIPTION OF THE INVENTION

Figure 1:
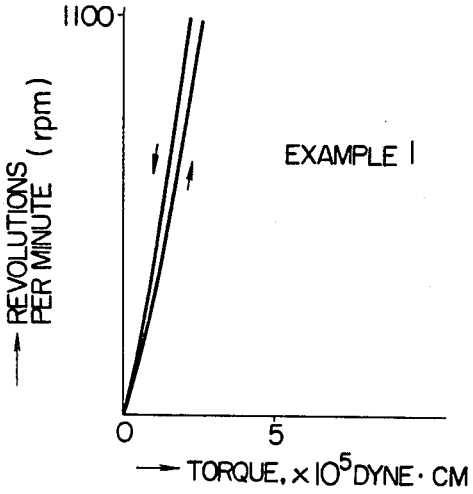
FIGS. 1 and 2 are rheological diagrams of the coating color in Examples 1 and 2 of this invention, respectively.

According to this invention, there were added a polyvinyl alochol and a styrene-butadiene latex both of which are used as dispersants and adhesives as well as a wax emulsion which is used as an additive to activated clay to obtain a coating color for a color developer sheet, which coating color is then applied to a support such as paper or the like to obtain a color developer sheet.

According to this invention, activated clay shows greatly improved dispersiveness in water and fluidity, and it becomes possible to lower the viscosity of the coating color, that is, to apply the coating color at a high concentration. Moreover, the applied amount becomes easy to control and hence coating workability has been improved. At the same time, energy saving has been practiced and productivity has been improved.

It has become apparent that the color developer sheet obtained maintains high surface strength, is free from stains on the blanket at the time of printing, shows no lowering of the depth of developed color, and gives excellent effects on the sunlight resistance of colored characters and on the aptitude for pasting.

The activated clay used in this invention is generally prepared by treating acid clay with an acid, washing it with water, drying and pulverizing it.

As the polyvinyl alcohol, there are preferably used those having a saponification degree of 88 mole % or more and a polymerization degree of 500 or more.

As the styrene-butadiene latex, there are preferably used those containing 55.0 to 65.0% by weight of styrene as the main component.

When the amount of styrene is higher than 65.0% by weight or lower than 55.0% by weight, the coated paper is low in water resistance, so that it becomes poor in aptitude for printing.

The objects of this invention can also be accomplished by using, as the styrene-butadiene latex used in this invention, a carboxyl-modified styrene-butadiene latex obtained by modifying a styrene-butadiene latex with an unsaturated carboxylic acid such as acrylic acid, methacrylic acid, itaconic acid, or the like in order to improve the adhesiveness and the water resistance.

The amount of the polyvinyl alcohol used in this invention is preferably 1.0 to 10.0% by weight, particularly preferably 2.5 to 6.0% by weight based on the activated clay, and the amount of the styrene-butadiene latex used is preferably 5.0 to 20.0% by weight (in terms of solids), particularly preferably 8.0 to 150% by weight (in terms of solids) based on the activated clay.

When the amounts of the polyvinyl alcohol and the styrene-butadiene latex are smaller than the above-mentioned lower limits, no sufficient fluidity can be obtained, and when they are higher than the above-mentioned upper limits, the coloring ability is lowered and hence the obtained sheet is unsuitable as a color developer sheet for no-carbon copying paper.

The wax used for preparing the wax emulsion used in this invention is solid at normal temperature. Examples of the wax include petroleum wax such as paraffin wax, microcrystalline wax, cresine wax, montan wax, powdered paraffin, oxidized paraffin, slack wax, and the like; and animal and vegetable wax such as Japan wax, white wax, carnauba wax, beeswax, castor wax, hardened wax, sugar wax, ibota wax, candelilla wax, and the like.

These waxes are solid at normal temperature, and therefore in adding them to a coating color for a color developer sheet for no-carbon copying paper, they cannot sufficiently been dispersed into the coating color unless they are emulsified.

Many of these waxes are commercially available in the form of an emulsion.

The preparation of a wax emulsion is explained below referring to the case of a 20% paraffin wax emulsion.

To 73.5 parts by weight of water is first added 1.5 part by weight of morpholine, and 5.0 parts by weight of oleic acid is subsequently added thereto with stirring, after which the resulting mixture is heated to a temperature near the boiling point, and heating and stirring are continued until a uniform soapy water is prepared. Twenty parts by weight of paraffin wax is melted in another vessel at 85.0° to 95.0° C., and the melted paraffin wax is gradually added to the aforesaid soapy water with vigorous stirring over a period of 5 minutes, after which the thus obtained mixture is cooled to room temperature with mild stirring.

A 20% paraffin wax emulsion is generally prepared by this process. As the emulsion stabilizer, there are those of acid-stabilizing type and nonion type in addition to the above-mentioned anionic type ones. However the emulsion stabilizer used in this invention is not limited thereto.

The amount of the wax emulsion is preferably 1.0 to 30.0% by weight (in terms of solids), particularly preferably 3.0 to 20.0% by weight (in terms of solids) based on the activated clay. When it is less than 1.0% by weight, the wax emulsion has no effect of preventing stains on the blanket, and when it is more than 30.0% by weight, the initial depth of developed color and the aptitude for pasting are reduced, so that the obtained sheet is unsuitable as a color developer sheet.

In this invention, a coating color for a color developer sheet is prepared by adding the polyvinyl alcohol, the styrene-butadiene latex and the wax emulsion to the activated clay, whereby the coating color is improved in dispersiveness at a high concentration and has excellent fluidity, and its coated amount becomes easy to control, and moreover the coating color can easily be fed to and recovered from the coater head, so that the workability of coating by means of a coater has greatly been improved.

There were obtained such effects that the color developer sheet obtained by coating a support such as paper with the above-mentioned coating color for a color developer sheet is free from stains on the blanket at the time of printing, shows no lowering of the depth of developed color, gives improved sunlight resistance of the colored characters, and is excellent in aptitude for pasting.

The term "high concentration" means that the coating color contains 45% or more of solids, but it is lower than a concentration used in ordinary coating.

Examples of this invention are described below.

As the color former sheet, commercially available top sheet "Mitsubishi NCR paper Joh-40" for no-carbon copying paper was used.

EXAMPLE 1

One hundred parts by weight of powdered activated clay was gradually added with stirring to a solution prepared by completely dissolving 0.5 parts by weight of sodium pyrophosphate in 60 parts by weight of additive water and then mixing therewith 50 parts by weight of a 10% aqueous solution of a polyvinyl alcohol (PVA-105 manufactured by Kuraray Co., Ltd., having a saponification degree of 98.5 mole % and a polymerization degree of 500). After the activated clay was sufficiently dispersed into said solution, 10 parts by weight (in terms of solids) of a styrene-butadiene latex (Dow 670 manufactured by Asahi Dow Co., Ltd., containing about 60% by weight of styrene) was added to the resulting dispersion, and the resulting mixture was well stirred. Thereafter 10 parts by weight (in terms of solids) of a paraffin wax (Cellosol A manufactured by Chukyo Oils and Fats, Co., Ltd. having a melting point of 53° C.) was added to the mixture and sufficiently dispersed thereinto, after which the pH of the thus obtained dispersion was adjusted to 9.5 with a 20% aqueous sodium hdyroxide solution to obtain a coating color. The coating color was applied to plain paper having 40 g/m$^2$ by means of a blade coater so that the applied amount might be 8 g/m$^2$ (in terms of solids), whereby a color developer sheet was produced.

EXAMPLE 2

A color developer sheet was produced in the same manner as in Example 1, except that the Cellosol A in Example 1 was replaced by an equal amount of Cellosol 866 (a paraffin wax emulsion manufactured by Chukyo Oils and Fats Co., Ltd., having a melting point of 60° C.).

Comparative Example 1

One hundred parts by weight of activated clay was gradually added with stirring to a solution prepared by completely dissolving 1.0 part by weight of sodium pyrophosphate in 60 parts by weight of additive water and then mixing therewith 50 parts by weight of a 10% aqueous solution of oxidized starch (MS-3800 manufactured by Nihon Food Co., Ltd.). After the activated clay was sufficiently dispersed into said solution, 10 parts by weight (in terms of solids) of a styrene-butadiene latex Dow 670 was added to the resulting dispersion, and the resulting mixture was well stirred, and then adjusted to pH 9.5 with a 20% aqueous sodium hydroxide solution to obtain a coating color. The coating color was applied to plain paper having 40 g/m$^2$ by means of a blade coater so that the applied amount might be 8 g/m$^2$, whereby a color developer sheet was produced.

Comparative Example 2

One hundred parts by weight of powdered activated clay was gradually added with stirring to a solution prepared by completely dissolving 0.5 parts by weight of sodium pyrophosphate in 60 parts by weight of additive water and then mixing therewith 50 parts by weight of a 10% aqueous solution of oxidized starch (MS-3800). After the activated clay was sufficiently dispersed into said solution, 10 parts by weight (in terms of solids) of a styrene-butadiene latex (Dow 670) was added to the resulting dispersion, and the resulting mixture was well stirred. Thereafter, 10 parts by weight (in terms of solids) of a paraffin wax emulsion (Cellosol A) was added to the mixture and sufficiently dispersed thereinto, after which the pH of the thus obtained dispersion was adjusted to 9.5 with a 20% aqueous sodium hydroxide solution to obtain a coating color. The coating color was applied to plain paper having 40 g/m$^2$ by means of a blade coater so that the applied amount might be 8 g/m$^2$ (in terms of solids), whereby a color developer sheet was produced.

Comparative Example 3

One hundred parts by weight of powdered activated clay was gradually added with stirring to a solution prepared by completely dissolving 0.5 parts by weight of sodium pyrophosphate in 60 parts by weight of additive water and then mixing therewith 50 parts by weight of a 10% aqueous solution of a polyvinyl alcohol (PVA-105). After the activated clay was sufficiently dispersed to said solution, 10 parts by weight (in terms of solids) of an acrylic latex (Tocryl S-20 manufactured by Toyo Ink Co., Ltd., a copolymer of acrylic ester and styrene) was added to the resulting dispersion, and the resulting mixture was well stirred, and then adjusted to pH 9.5 with a 20% aqueous sodium hydroxide solution to obtain a coating color. The coating color was applied to plain paper having 40 g/m$^2$ by means of a blade coater so that the applied amount might be 8 g/m$^2$ (in terms of solids), whereby a color developer sheet was produced.

Test Methods

The thus obtained solutions and color developer sheets were subjected to various tests in the following manners.

(1) Coating color (i) Viscosity

The viscosity (cps: centipoise) at 60 r.p.m. after 1 minute were measured by means of a B type viscometer (manufactured by Tokyo Meters Co., Ltd.) by using a rotor No. 4.

The viscosity curves were obtained by a Harcules II type high-share viscometer (manufactured by Nihon Science Industry Co., Ltd.)

(ii) Solid content

Each of the coating colors was dried at 110° C. for 16 hours and then its solid residue was measured.

(2) Color developer sheet (i) Depth of developed color

The color developer sheet was put together with the color former sheet and they were passed through a calender under a pressure of 96 kg/cm$^2$ to develop color, and the reflectance (%) was measured by means of a colorimeteric color difference meter manufactured by Nihon Denshoku Co., Ltd., and the following value was determined.

$$\text{Depth of developed color (\%)} = \frac{\text{Reflectance of a colored part}}{\text{Reflectance of an uncolored part}} \times 100$$

(1 hour after passing the sheets through the calender)

(ii) Sunlight resistance of colored characters

The color developer sheet colored by passing it through the aforesaid calender was exposed to the sun for 2 hours, and the reflectance (%) was measured by means of a colorimetric color difference meter manufactured by Nihon Denshoku Co., Ltd., and the following value was determined.

$$\text{Sunlight resistance} = \frac{\text{Reflectance of a colored part after exposure to the sun}}{\text{Reflectance of an uncolored part after exposure to the sun}} \times 100$$

(iii) Surface strength

The measurement was carried out by means of an IGT tester (manufactured by Kumai Riki Co., Ltd.) by using IPI No. 4 ink and a B spring. The strength is expressed by ○ or Ⓐ.

(iv) Stains on blanket (piling)

The test was carried out by means of a Miyaster 17 type printer (manufactured by Miyakoshi Machine Factory) by using commercially available offset ink (blue). The degree of stains on blanket in this case is expressed by ○, Δ or X.

(v) Aptitude for pasting

A commercially available top sheet "Mitsubishi NCR paper Joh-40" for no-carbon copying paper and each of under sheets (the color developer sheets) obtained in Examples 1 and 2 and Comparatives Examples 1, 2 and 3 were put together to make a set of no-carbon copying paper, and 500 sets were piled up so that the top sheet and the under sheet might be alternately placed upon each other, and then cut. Commercially available "Adhesive for Mitsubishi NCR paper" (also called "paste") was applied to the transverse section and then dried, after which the bonding strength between the top sheet and the under sheet both of which constitute a set of no-carbon copying paper and the separability between the under sheet and the top sheet (between sets) were observed. The contact angle of the color developer sheets was also measured.

The bonding strength and the separability are expressed by ⊙, ○, Ⓐ or X.

Results (1) Coating color

Figure 2:
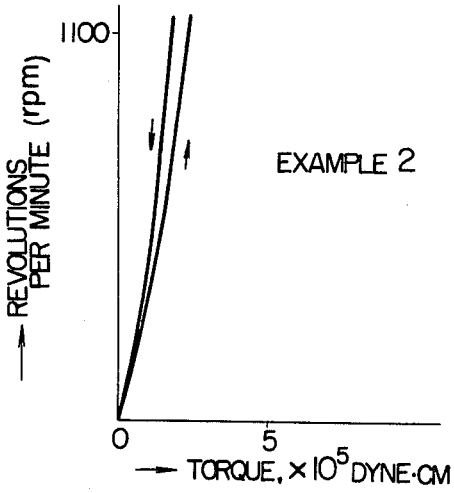
Figure 3:
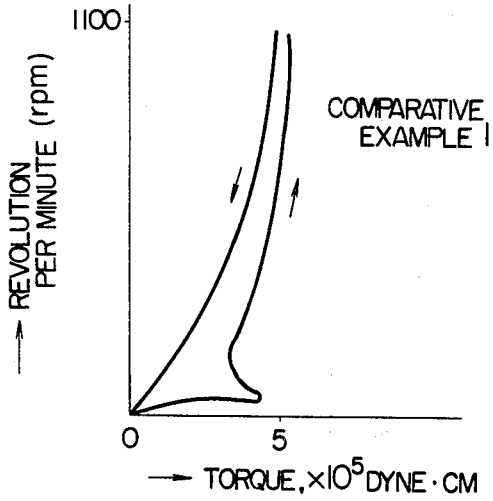
FIGS. 3, 4 and 5 are rheological diagrams of coating color in Comparative Examples 1, 2 and 3, respectively.
Figure 4:
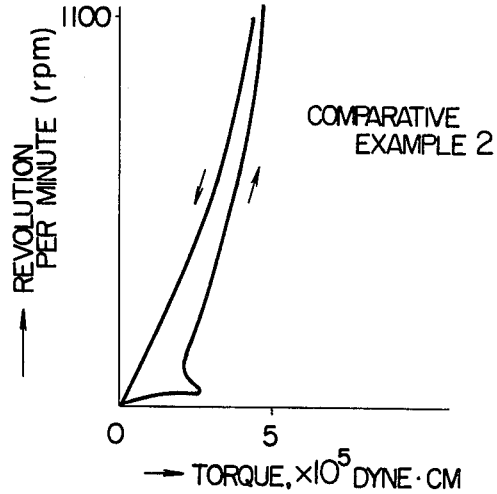
Figure 5:
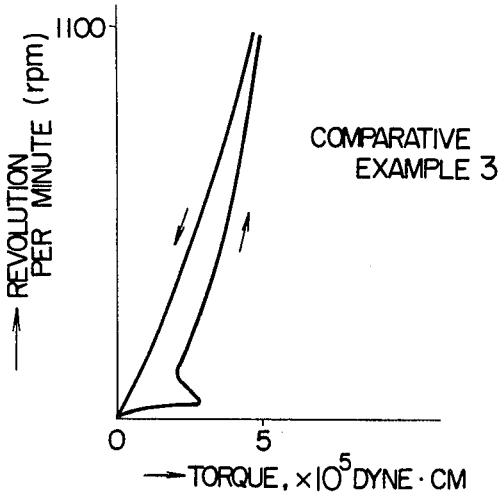

The solid contents, viscosities and fluidity of the coating colors used in Examples and Comparative Examples are shown in Table 1. The viscosity curves for the coating colors in Examples and Comparative Examples are shown in FIGS. 1, 2, 3, 4 and 5.

TABLE 1

| | Solid content | B type viscosity | Fluidity of a coating color |
|---|---|---|---|
| Example 1 | 45.2% | 1520 cps | Good |
| 2 | 45.3 | 1500 | " |
| Comparative Example 1 | 45.0 | 6050 | Gelled |
| 2 | 45.5 | 5400 | " |
| 3 | 45.8 | 5250 | " |

It can be seen from Table 1 that as compared with the coating colors in Comparative Examples 1, 2 and 3, the coating colors in Examples 1 and 2 of this invention have greatly lowered viscosities and good fluidity, though they have the same solid contents as the former coating colors. As is obvious from FIGS. 1, 2, 3, 4 and 5, the coating colors in Comparative Examples 1, 2 and 3 have higher viscosities at high revolutions as compared with those in Examples 1 and 2, and even at low revolutions, they have high viscosities and are gelled.

(2) Color developer sheet

TABLE 2

| | Depth of developed color | Sunlight resistance of developed characters | Surface strength | Stains on blanket |
|---|---|---|---|---|
| Example 1 | 28.2 | 40.5 | ○ | ○ |
| 2 | 28.3 | 40.9 | ○ | ○ |
| Comparative Example 1 | 27.9 | 47.1 | Ⓐ | X |
| 2 | 29.0 | 43.0 | ○ | Δ |

TABLE 2-continued

| | Depth of developed color | Sunlight resistance of developed characters | Surface strength | Stains on blanket |
|---|---|---|---|---|
| 3 | 28.8 | 48.2 | ○ | X |

Marks used in Tables 2 and 3 have the following meanings.
⊙: excellent
○: good
Ⓐ : worse than ○ but better than Δ
Δ: average
X: bad

TABLE 3

| | Aptitude for pasting | | |
|---|---|---|---|
| | Contact angle | Bonding strength | Separability |
| Example 1 | 29° | ⊙ | ○ |
| 2 | 27 | ⊙ | ○ |
| Comparative Example 1 | 40 | Ⓐ | ○ |
| 2 | 65 | X | X |
| 3 | 22 | Ⓐ | ○ |

It is clear from Tables 1, 2 and 3 that the fluidity of a coating color is improved by adding a polyvinyl alcohol, a styrene-butadiene latex and a wax emulsion to solid (powdered) activated clay previously incorporated with a dispersant, and that a color developer sheet obtained by using said coating color shows improved sunlight resistance of colored characters. Further stains on the blanket at the time of printing is prevented and excellent aptitude for pasting is brought about.

What is claimed is:

1. Pressure sensitive no-carbon copying paper composed fundamentally of a color former sheet produced by coating a support with microcapsules containing a colorless electron-donative organic compound as a color former and a color developer sheet produced by coating a support with a coating color containing activated clay as a color developer which adsorbs the aforesaid electron-donative organic compound to develop color, wherein the aforesaid activated clay-containing coating color is prepared by adding a polyvinyl alcohol, a styrene-butadiene latex and an emulsion of wax which is solid at room temperature to activated clay.

2. Pressure sensitive no-carbon copying paper according to claim 1, wherein the polyvinyl alcohol has a saponification degree of 88 mole % or more and a polymerization degree of 500 or more.

3. Pressure sensitive no-carbon copying paper according to claim 1 or 2, wherein the polyvinyl alcohol is used in an amount of 1.0 to 10.0% by weight based on the activated clay and the styrene-butadiene latex is used in an amount of 5.0 to 20.0% by weight (in terms of solids) based on the activated clay.

4. Pressure sensitive no-carbon copying paper according to claim 1, wherein the amount of the wax emulsion is 1.0 to 30.0% by weight (in terms of solids) based on the activated clay.

5. Pressure sensitive no-carbon copying paper according to claim 1, wherein the styrene-butadiene latex contains 55.0 to 65.0% by weight of styrene as the main component.

6. Pressure sensitive no-carbon copying paper according to claim 1 or 5, wherein the styrene-butadiene latex is a carboxyl-modified styrene-butadiene latex.

7. No-carbon copying paper according to claim 1, wherein said color developer sheet includes a sheet (intermediate sheet) produced by providing the right side of a support with a color developer layer of activated clay and its backside with a layer of microcapsules containing a color developer.

* * * * *